US010683131B2

(12) United States Patent
Zortea et al.

(10) Patent No.: US 10,683,131 B2
(45) Date of Patent: Jun. 16, 2020

(54) BUILT-IN HEADER FOR DISPLAY TRAY

(71) Applicant: Intercontinental Great Brands LLC, East Hanover, NJ (US)

(72) Inventors: Greta Lais Boff Zortea, Curitiba (BR); Daniel Marcelo Di Santi Correa da Silva, Curitiba (BR)

(73) Assignee: Intercontinental Great Brands LLC, East Hanover, NJ (US)

( * ) Notice: Subject to any disclaimer, the term of this patent is extended or adjusted under 35 U.S.C. 154(b) by 108 days.

(21) Appl. No.: 15/752,949

(22) PCT Filed: Aug. 17, 2016

(86) PCT No.: PCT/US2016/047279
§ 371 (c)(1),
(2) Date: Feb. 15, 2018

(87) PCT Pub. No.: WO2017/048442
PCT Pub. Date: Mar. 23, 2017

(65) Prior Publication Data

US 2018/0237181 A1 Aug. 23, 2018

Related U.S. Application Data

(60) Provisional application No. 62/218,228, filed on Sep. 14, 2015.

(51) Int. Cl.
*B65D 5/52* (2006.01)

(52) U.S. Cl.
CPC ..... *B65D 5/5226* (2013.01); *B65D 5/5246* (2013.01)

(58) Field of Classification Search
CPC .... B65D 5/522; B65D 5/5226; B65D 5/5246; B65D 5/4216; B65D 5/4225; B65D 5/4233; B65D 2571/0851; B65D 2571/00851
USPC ..... 206/767, 768, 459.5; 40/312; 229/116.1
See application file for complete search history.

(56) References Cited

U.S. PATENT DOCUMENTS

| | | | | | |
|---|---|---|---|---|---|
| 1,033,550 | A * | 7/1912 | Crankshaw | B65D 5/522 | 206/45.28 |
| 1,499,987 | A * | 7/1924 | Roe | B65D 5/5206 | 206/45.25 |
| 1,508,337 | A * | 9/1924 | Jensen | B65D 5/522 | 206/45.28 |
| 3,219,181 | A * | 11/1965 | Dahm | B65D 5/542 | 206/45.21 |
| 3,674,133 | A * | 7/1972 | Locke | B65D 5/2038 | 206/767 |

(Continued)

FOREIGN PATENT DOCUMENTS

| | | | |
|---|---|---|---|
| JP | S57-007616 | Y2 | 2/1982 |
| JP | H7-47309 | Y | 11/1995 |
| JP | 2006-188238 | A | 7/2006 |

*Primary Examiner* — Steven A. Reynolds
(74) *Attorney, Agent, or Firm* — Hoffmann & Baron, LLP

(57) ABSTRACT

A package (30) is provided for containing, dispensing and displaying products (64) such as confectionery products. The package includes a floor (32) and an upstanding perimeter wall (40) bounding the floor and defining an open end (42). The floor includes a detachable portion (70) which can be detachably removed therefrom and attached to an upper edge of the perimeter wall to form a display header (52) which can display information regarding the product at the point of purchase.

12 Claims, 14 Drawing Sheets

(56) References Cited

U.S. PATENT DOCUMENTS

| | | | | |
|---|---|---|---|---|
| 4,801,774 | A * | 1/1989 | Hart | B65D 5/48004 219/730 |
| 4,828,164 | A | 5/1989 | Passamoni | |
| 5,377,821 | A * | 1/1995 | Fierek | B65D 5/42 206/459.5 |
| 6,158,579 | A * | 12/2000 | Rosenbaum | B65D 5/48026 206/45.29 |
| 6,837,379 | B2 * | 1/2005 | Dennis | B65D 5/4216 206/45.29 |
| 9,950,847 | B2 * | 4/2018 | Hayton | B65D 71/10 |
| 2003/0150773 | A1 * | 8/2003 | Dennis | B65D 5/4216 206/767 |

* cited by examiner

BUILT-IN HEADER FOR DISPLAY TRAY

CROSS REFERENCE TO RELATED APPLICATIONS

This application is the National Stage of International Application No. PCT/US2016/047279, which designates the U.S., filed Aug. 17, 2016, which claims the benefit of U.S. Provisional Patent Application No. 62/218,228 filed Sep. 14, 2015, the contents of all of which are incorporated herein by reference in its entirety.

FIELD OF THE INVENTION

The present invention relates generally to a tray for containing, displaying and dispensing product. More particularly, the present invention relates to a package forming a display tray which provides a detachable portion which can be reattached as a header.

BACKGROUND OF THE INVENTION

Packages are often used to display and dispense product particularly confectionery products such as gum, candy and the like. These packages are typically placed at the point of sale. Packages in the form of trays contain the product for display at the point of sale so that consumers can remove one or more of the products from the package.

In order to enhance the visual display, a header may be placed on the package to provide advertising and other information as to the contents in the package. In many of the prior art display trays a separately formed header is provided, which must be attached to the package for display purposes. This increases the cost of the package in that a separate header must be supplied. In other situations the cover of the package may be removed or manipulated to form the display header. In this situation, the package must include a closed cover which again increases the cost of the package.

SUMMARY OF THE INVENTION

In one aspect, the present invention provides a package for containing, dispensing and displaying products. The package includes a floor having a perimeter. An upstanding perimeter wall extends from a bottom edge upward to a top edge, and extends around the perimeter of the package floor. The top edge defines an open package top. The perimeter wall has a front wall and a rear wall extending transversely across the package. A pair of opposed perimeter side walls extend between the front wall and the rear wall. A detachable portion of the package floor is detachably removed therefrom, preferably by perforations, and is attachable to the perimeter walk preferably the top edge of the rear wall, to form a display header.

The detachable portion forming the header has a transverse dimension, which is less than the dimension of the product contained in the package. This ensures that the product does not fall through the floor after removal of the display header. The floor has a perimeter margin including a front margin and a rear margin and a pair of side margins. The header is shown as rectangular, but can be of any shape. The detachable portion includes either graphics or indicia, or both. The detachable portion includes a tongue formed by a non-straight slit through the detachable portion. The tongue is adapted to bend away from the detachable portion sufficiently to allow the detachable portion to sandwich the rear wall between the header and the tongue.

In another aspect, a method is disclosed for containing, dispensing and displaying products in a package. The method comprises providing the package with a package floor. An upstanding perimeter wall is extended around a perimeter of the package floor. A detachable portion is removed from the package floor. The detachable portion is attached to a top edge of the perimeter wall to form a display header.

DETAILED DESCRIPTION OF PREFERRED EMBODIMENTS

Figure 1:
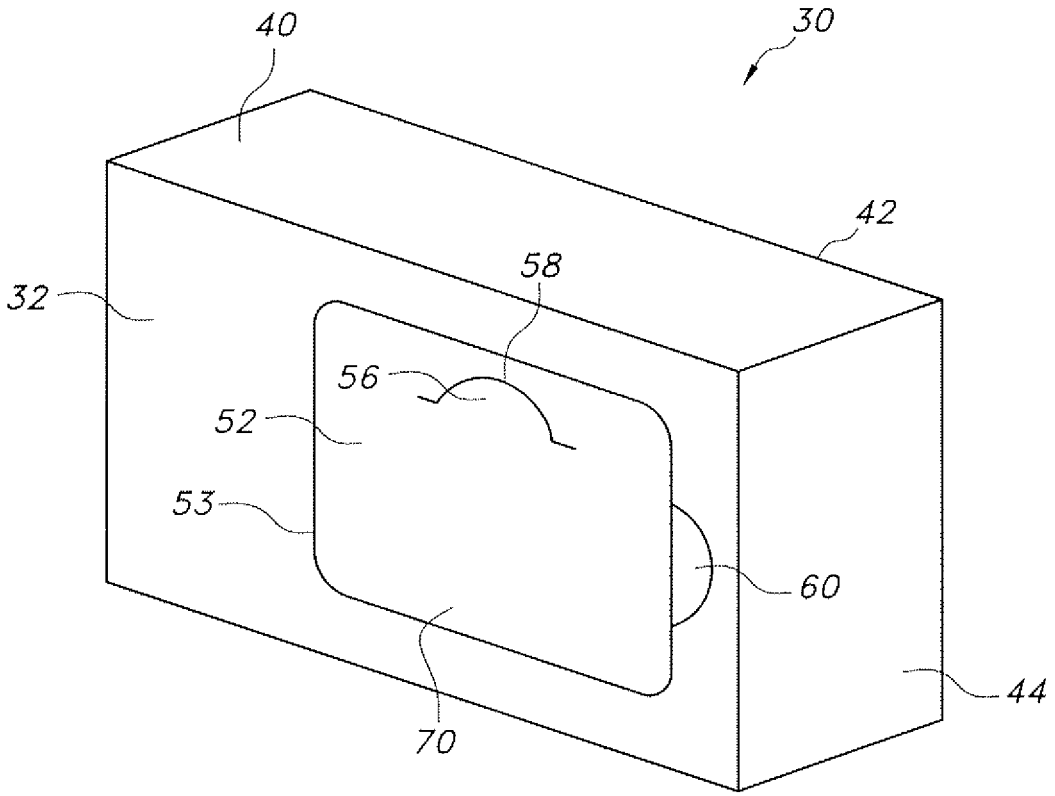
FIG. 1 is a bottom perspective view of a package used to display and dispense products, constructed in accordance with the invention, and showing a header for the display tray removably built into the package floor.
Figure 2:
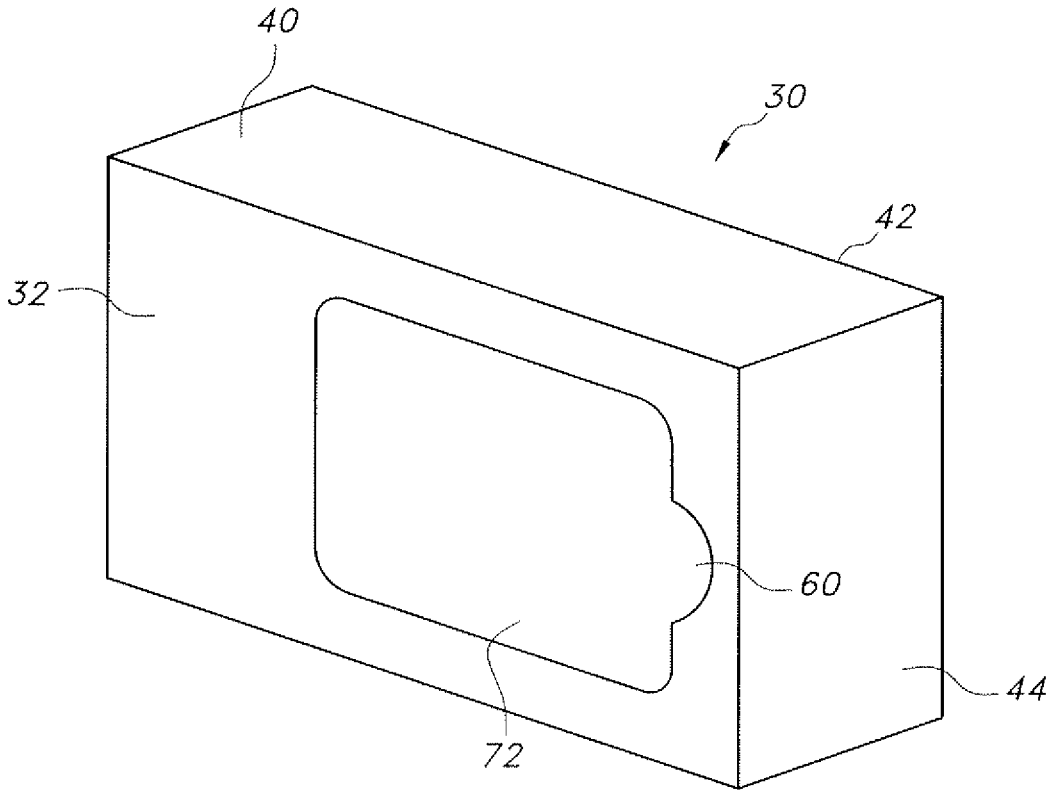
FIG. 2 is a bottom perspective view of the package of FIG. 1, and showing the display header removed from the package floor.
Figure 3:
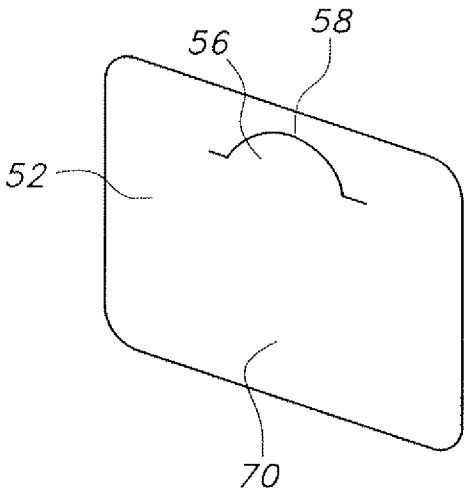
FIG. 3 is a perspective view of the display header from the package of FIG. 1.

Referring now to FIGS. 1-11, a package for containing, dispensing and displaying products 64 is shown at 30. The products 64 may be preferably displayed at the point of sale (POS). The package 30 forms a display tray 28 for displaying and dispensing the products 64.

The package 30 includes a rectangular floor 32, having a perimeter. An upstanding perimeter wall 40 extends from a bottom edge 43 upward to a top edge 42. The bottom edge 43 extends completely around the perimeter of the package floor 32, bounding the floor 32. The top edge 42 defines an open package top 31. The perimeter wall 40 has a front wall 46 and a rear wall 44 extending transversely (sideways left to right) across the package 30. The perimeter wall 40 has a pair of opposed perimeter side walls 47 extending between the front wall 46 and the rear wall 44, which flank the package 30 on either side. A detachable portion 70 of the package floor 32 is detachably removed therefrom, preferably by perforations 53, and is attachable to the top edge 42 of the perimeter wall 40 to form a display header 52. Preferably, the detachable portion 70 is attachable to the rear wall 44. The perimeter wall 40 includes a perimeter wall inner surface 48, and an outer surface 50.

The package 30, which has an open top 31, is enclosed by an overwrap, which is removed to dispense the products 64. The open top 31 reduces the amount of packaging material needed.

In a desirable embodiment, the detachable portion forming header 52 has a transverse dimension, which is less than the dimension of the product contained in the package. This ensures that the product does not fall through the floor after removal of the display header 52. A hole 72 is formed in the package floor 32 upon removing the detachable portion 70 from the package floor 32. The hole 72 has a hole transverse dimension 74. The hole transverse dimension 74 is less than a product transverse dimension when the product is contained transversely in the package, i.e., the length of the product from left to right as it sits in the package. The floor perimeter margin 33 and floor side margins 38 will support the products 64. Thus, the products 64 will not pass through the hole 72 and fall out of the package. The floor front margin 34 and the floor rear margin 36 include the remainder of the floor 32 and fully support the products 64.

The floor 32 may be rectangular having a floor perimeter margin 33 including the front margin 34, the rear margin 36, and the side margins 38. After removal from the floor 32, the detachable portion forming the header 52 may then be attached to the perimeter wall 40. The header 52 is typically attached to a rear wall 44 of the perimeter wall 40, so as to be displayed facing outward toward the consumer. The header 52 can be attached to any portion of the perimeter wall 40. The header 52 is shown as rectangular, but can be of any shape. The detachable portion 70 includes either graphics or indicia or preferably, both.

Figure 4:
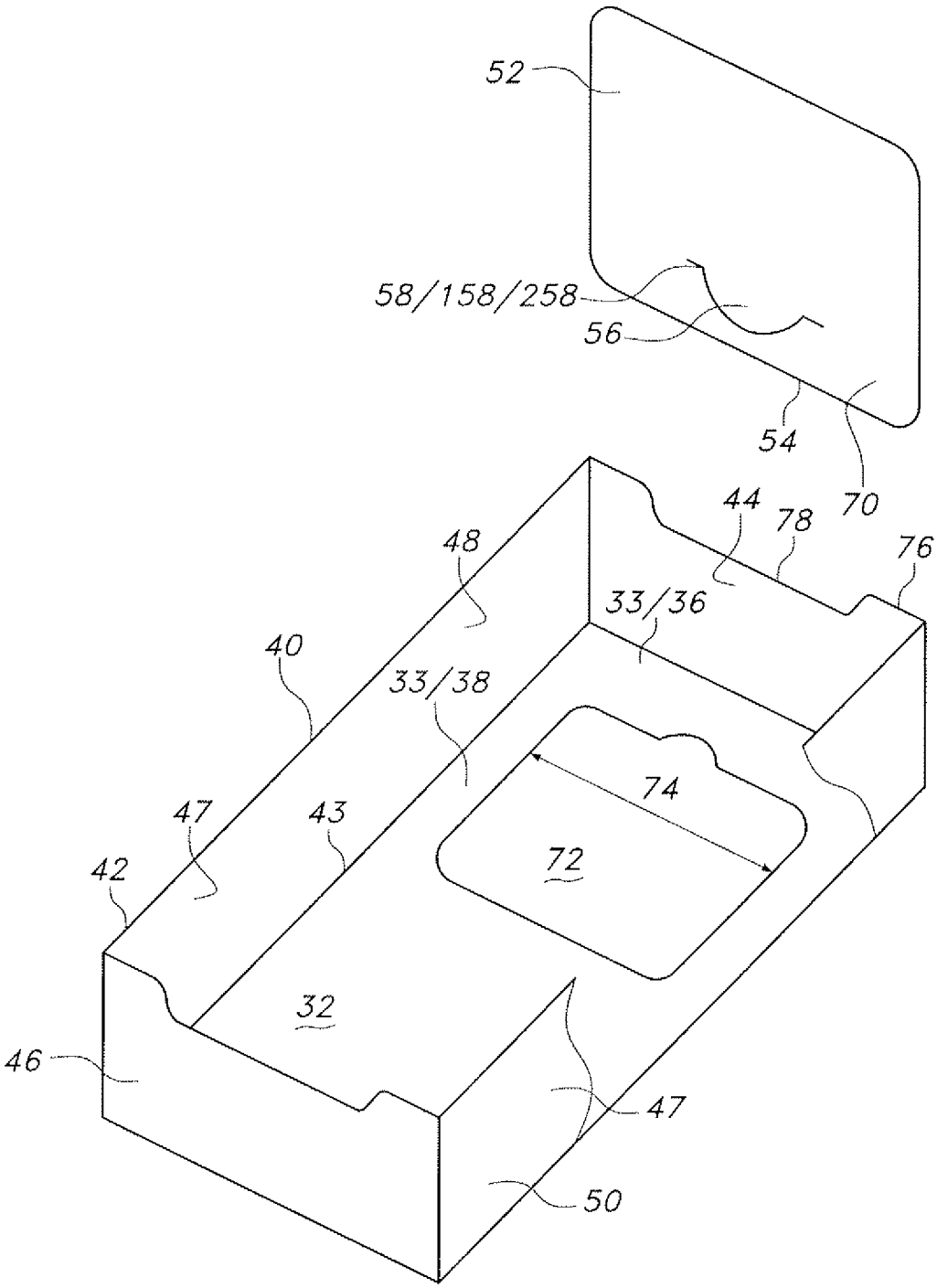
FIG. 4 is a perspective view of the package of FIG. 1, and showing the display header disposed above the package open upper end.
Figure 5:
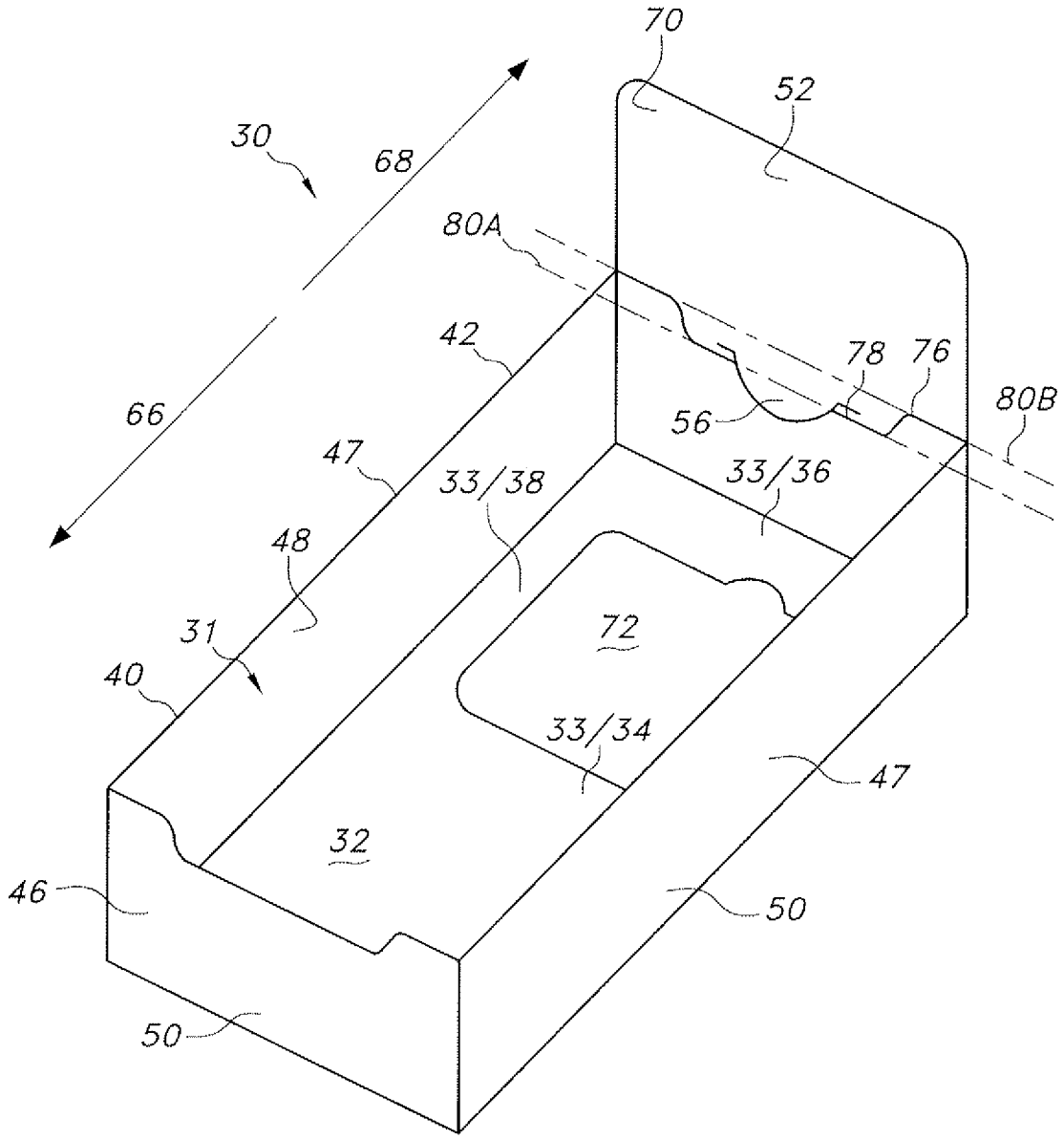
FIG. 5 is a perspective view of the package of FIG. 1, and showing the display header attached to the package open upper end at the perimeter wall rear wall.
Figure 6:
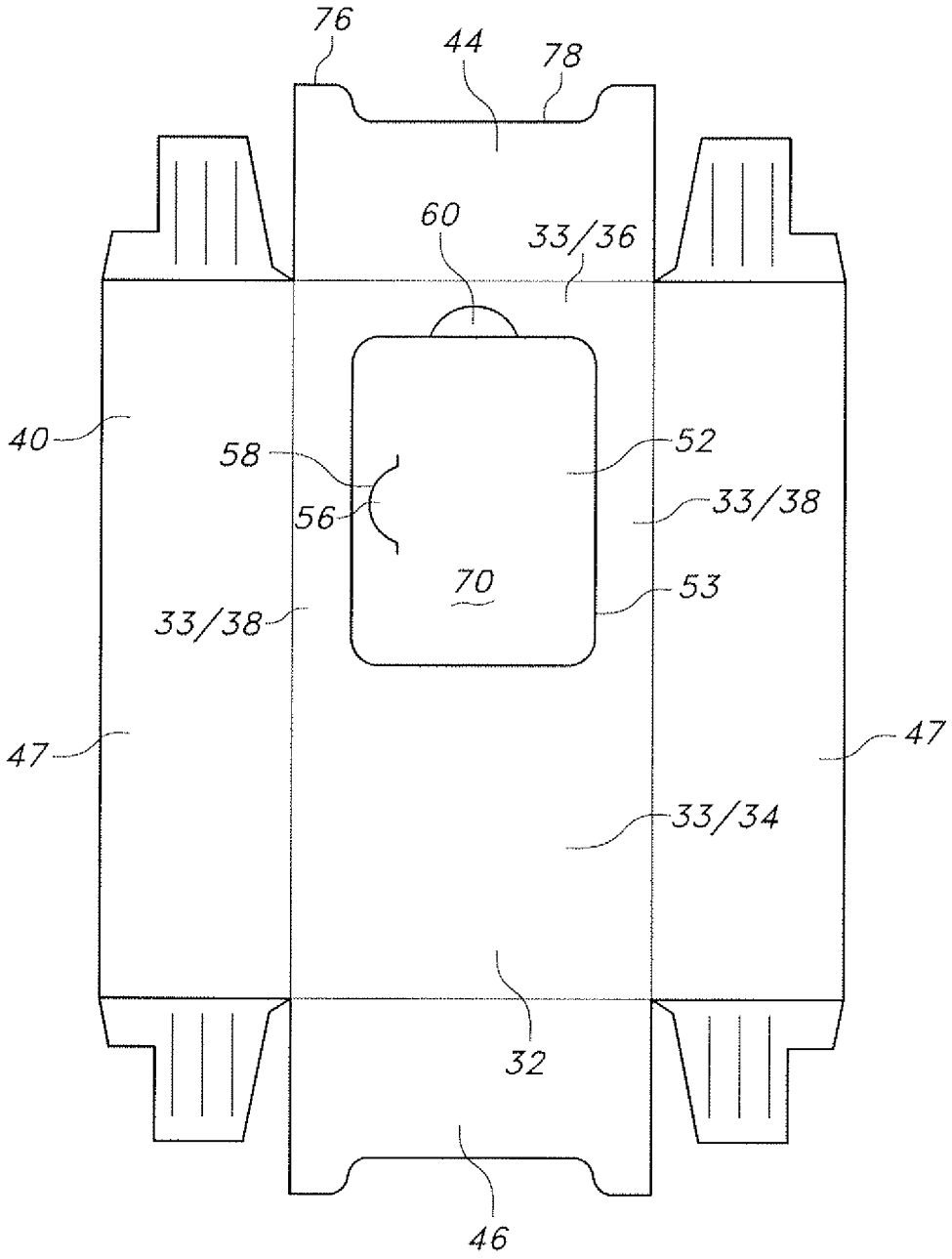
FIG. 6 is a top plan view of the package of FIG. 1, and showing a pattern layout of the package before cutting and folding to form the tray.
Figure 7:
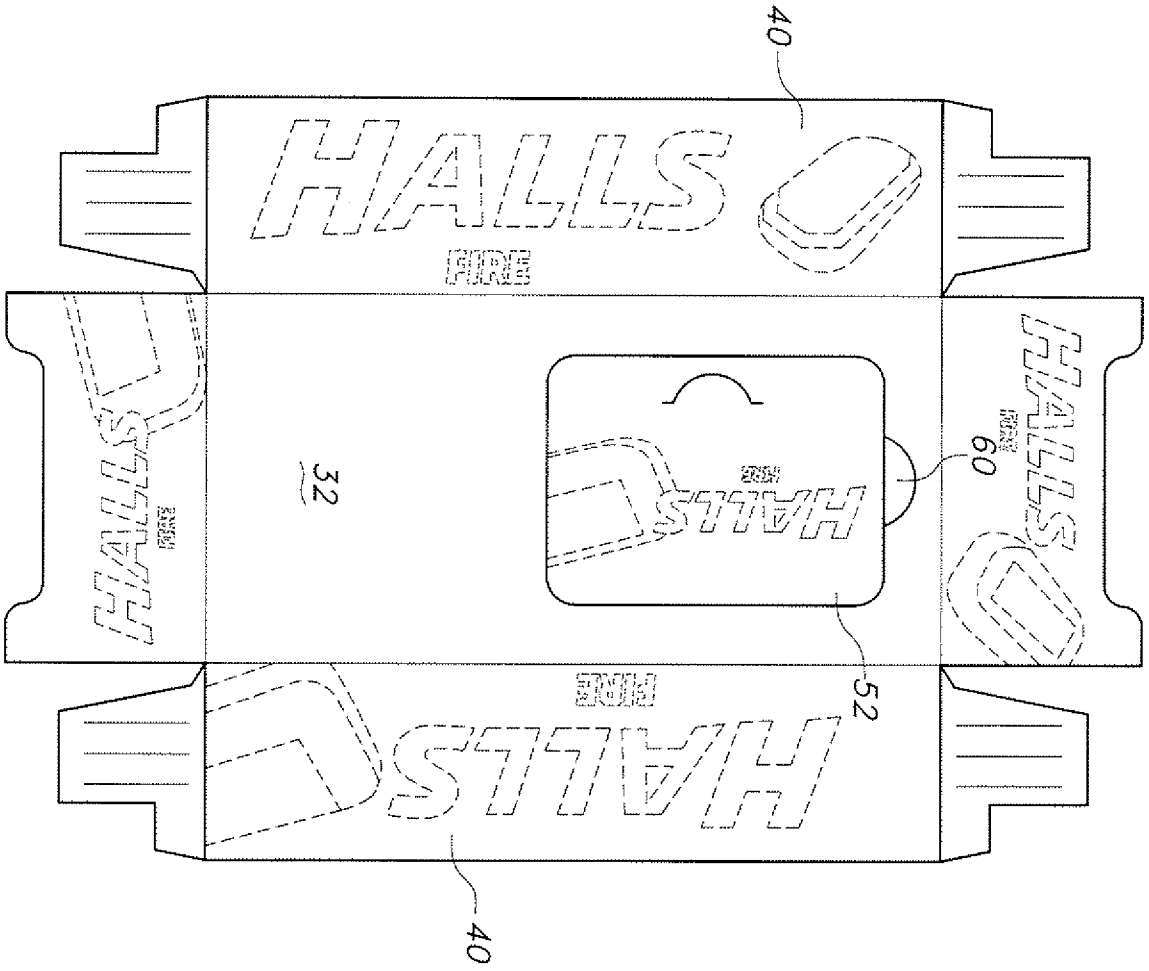
FIG. 7 is a top plan view of the package of FIG. 1, and showing the pattern layout of the package with graphics and indicia printed thereon.
Figure 8:
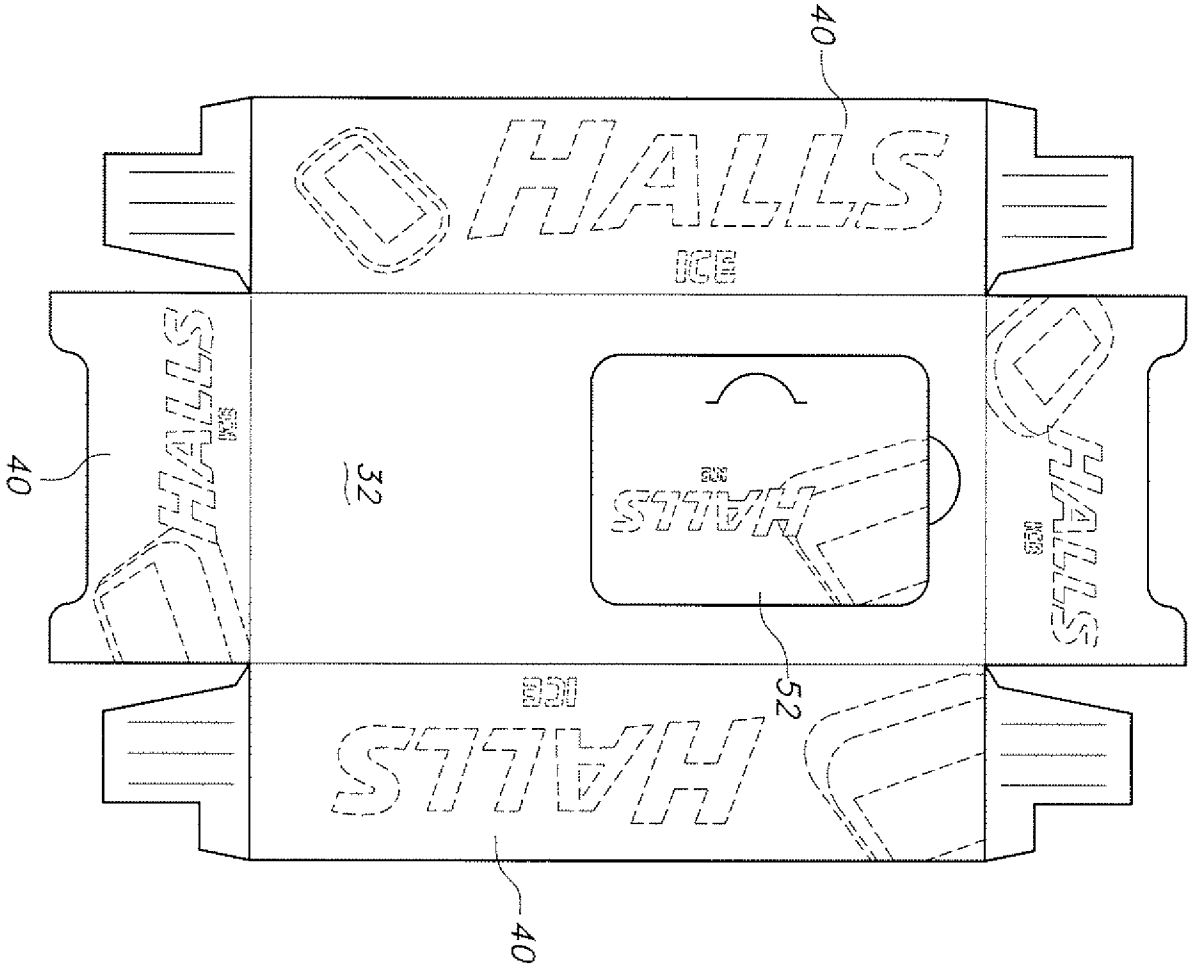
FIG. 8 is a top plan view of the package of FIG. 1, and showing the pattern layout of the package with further graphics and indicia printed thereon.
Figure 9:
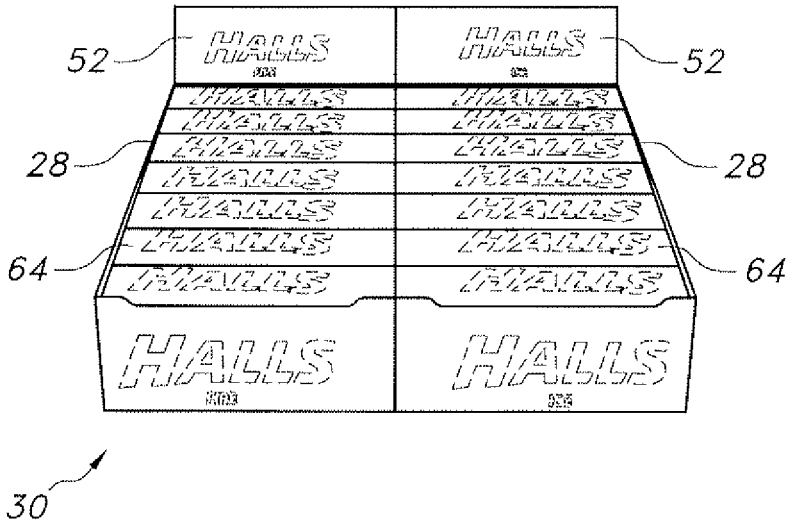
FIG. 9 is a perspective view of two package trays constructed as in FIG. 1, and showing each tray with the display header attached to the package open upper end at the perimeter wall rear wall.
Figure 10:
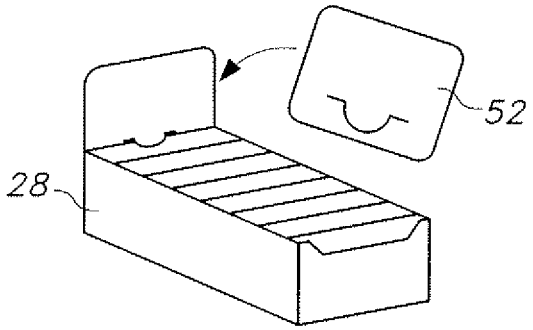
FIG. 10 is a perspective view of the package of FIG. 1, and showing a method of attaching the display header to the perimeter wall rear wall.

The display header 52 has a lower edge 54. The detachable portion 70 includes a tongue 56 formed by a non-straight slit 58 through the detachable portion 70. The tongue 56 is shown as arcuate, but can be of any shape. Examples are non-limitingly: trapezoidal, rectangular, or triangular (not shown). The detachable portion 70 is attachable to the rear wall 44. Upon attaching the header 52 to the perimeter wall rear wall 44, the header lower edge 54 slidingly engages the perimeter wall outer surface 50. The tongue 56 slidingly engages the perimeter wall inner surface 48. The tongue 56 is adapted to bend away from the detachable portion 70 sufficiently to allow the detachable portion 70 to sandwich the rear wall 44 between the header 52 and the tongue 56. Thus, the assembly sandwiches the perimeter wall top edge 42 between the header lower edge 54 and the tongue 56, as shown in FIGS. 4 and 5, thereby securing the header 52 to the package 30. After attaching the detachable portion 70 to the rear wall 44, the header 52 extends upward from the rear wall 44.

In this embodiment, the detachable portion 70 will sandwich the rear wall 44 with the header 52 behind the rear wall 44 and the tongue 56 in front of the rear wall 44, as shown in FIG. 5. The top edge 42 of the rear wall 44 includes at least one upper part 76 and at least one lower part 78 disposed below the upper part 76. Typically, the top edge 42 will have two upper parts 76 flanking one lower part 78, as shown in FIGS. 4 and 5. The detachable portion 70 attaches to the lower part 78 of the top edge 42 of the rear wall 44.

It is to be understood that the top edge 42 of the rear wall 44 may not necessarily include an upper part 76 and a lower part 78. The top edge 42 of the rear wall 44 may be straight across (not shown). Furthermore, the top edge 42 of the perimeter wall 40 may extend completely around the perimeter of the package 30 at a uniform height (not shown). Yet further, the detachable portion 70 may be attached to the perimeter wall 40 anywhere on the perimeter wall 40. The wall configurations shown herein are examples of desirable embodiments and are non-limiting.

A lower axis of collapse 80A extends transversely across the rear wall 44 adjacent the rear wall lower part 78. An upper axis of collapse 80B extends transversely across the rear wall 44 adjacent the rear wall upper part 76. The axis of collapse 80A, 80B is a rotational centerline about which the header 52 would have to pivot if the header were to collapse either rearward 68 or forward 66, respectively. Thus, in order for the header 52 to collapse rearward the header 52 will bend at the lower axis 80A. Similarly, in order for the header 52 to collapse forward the header 52 will bend at the upper axis 80B. The upper part 76 is above the tongue 56, and in front of the header 52, and will therefore resist any bending in the forward direction 66. Thus, the upper part 76 will support the header 52 and preclude the header 52 from collapsing forward. In addition, the rear wall 44 is contiguous with and at right angles to the side walls 47. The upper part 76 is thereby reinforced by the side walls 47.

The floor 32 of the package 30 includes a finger hole 60, into which a finger is inserted to remove the detachable portion 70, forming the header 52, from the floor 32. The finger hole 60 can be an opening or a slit portion adapted to be pushed inward to form an opening.

Figure 11:
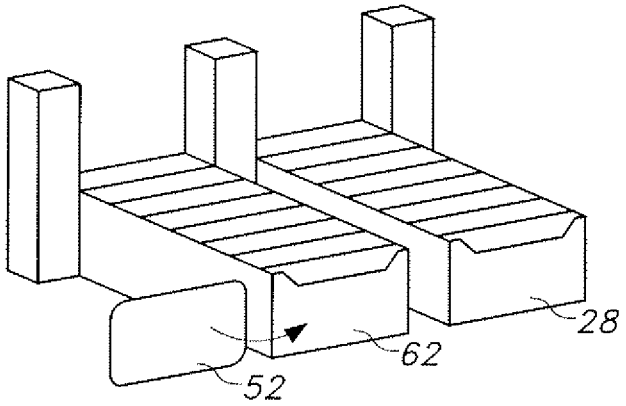
FIG. 11 is a perspective view of the package of FIG. 1, and showing a method of attaching the display header to the perimeter wall front wall.

Turning now to FIG. 11, as well as FIGS. 1-10, an alternative embodiment is shown in which the header 52 can be attached to a front wall 46 of the perimeter wall 40. The header 52 is displayed facing outward toward the consumer. In this embodiment, a transparent cover or sleeve 62 is disposed at the perimeter wall front wall 46. The header 52 is removed from the floor as described above, and is inserted into the sleeve 62, as shown in FIG. 11.

Figure 12:
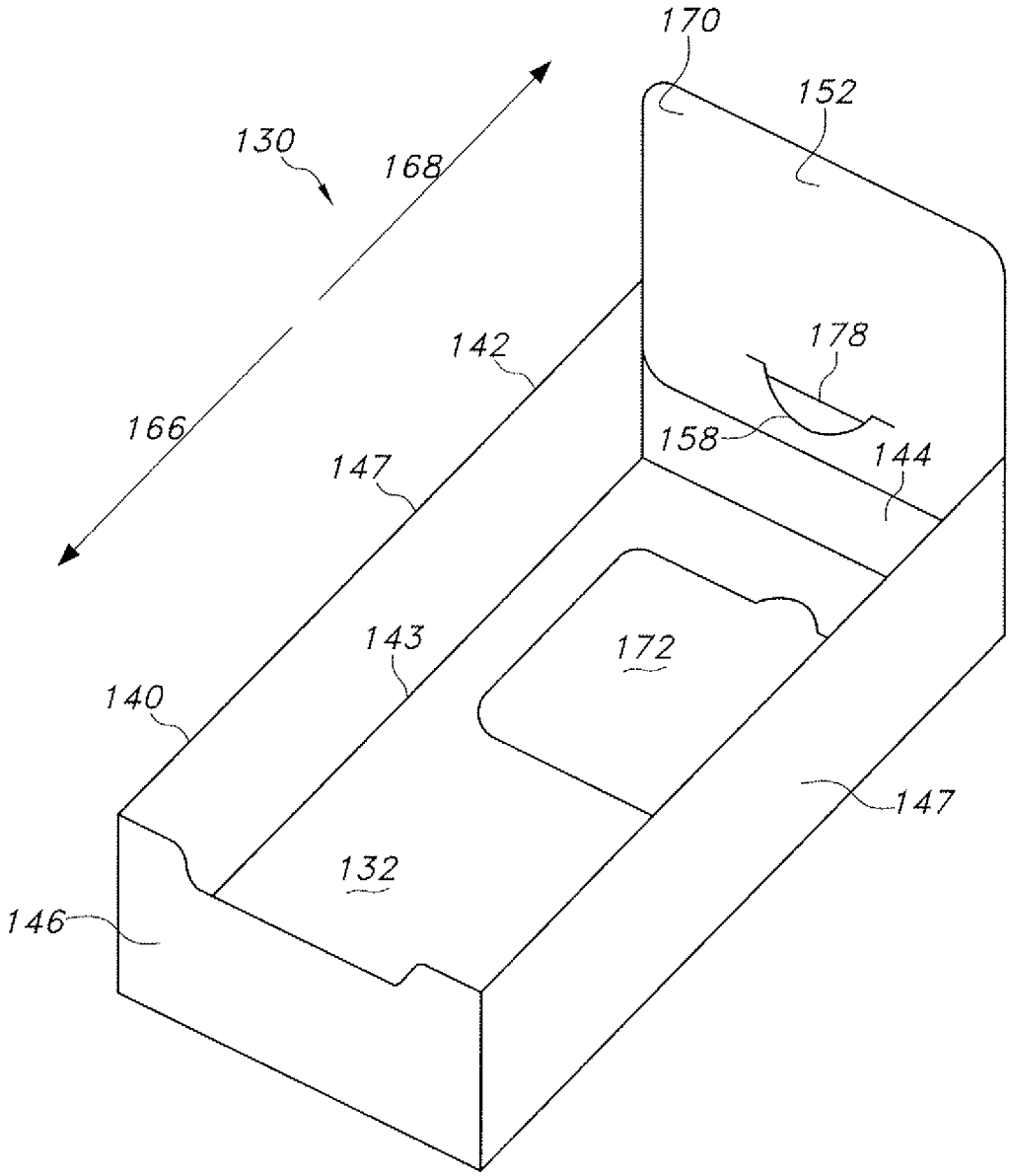
FIG. 12 is a top perspective view of another package constructed in accordance with the invention, and showing the display header attached to the package open upper end at the perimeter wall rear wall.
Figure 13:
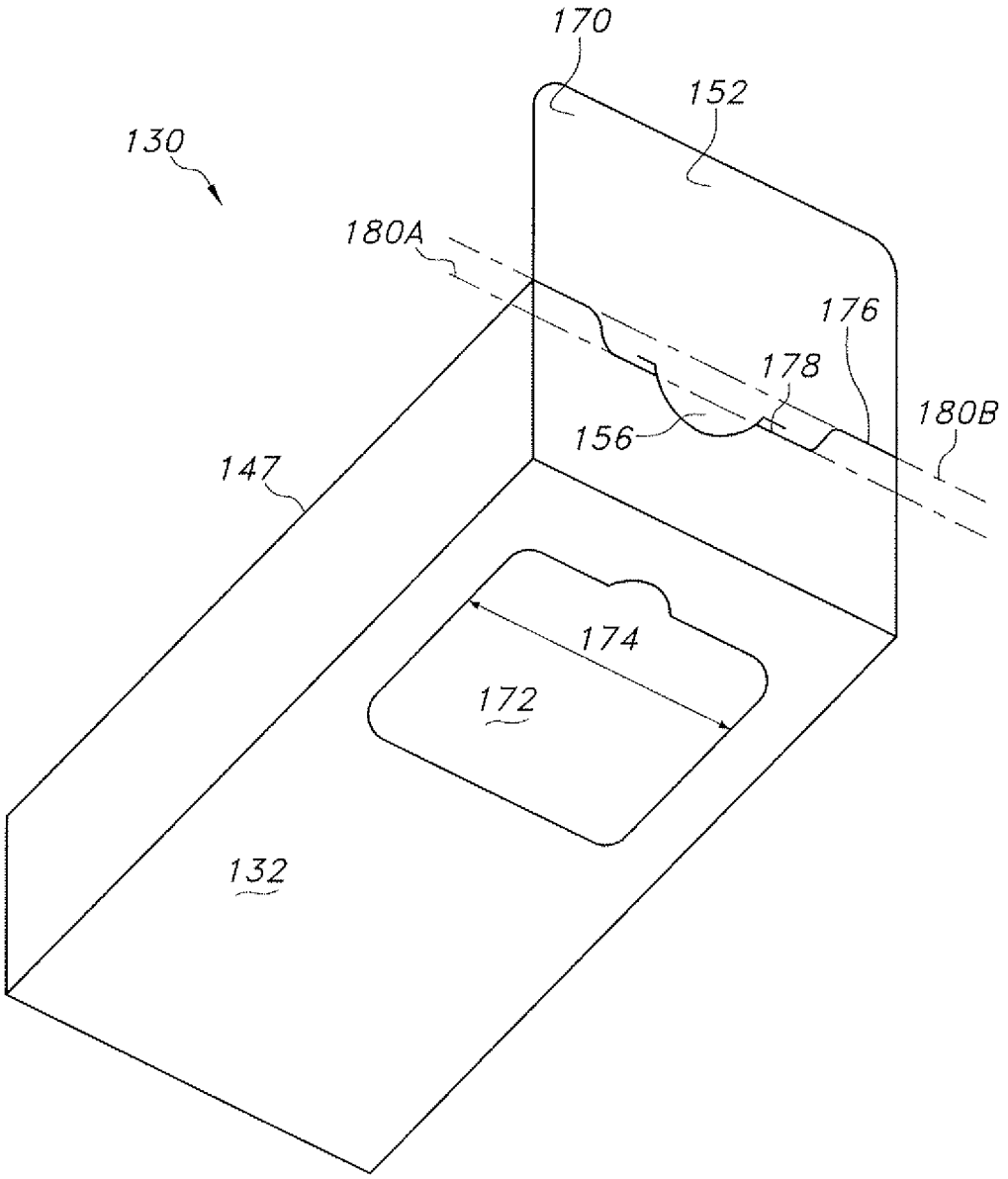
FIG. 13 is a bottom perspective view of the package of FIG. 12, and showing a method of attaching the display header to the perimeter wall rear wall.

Referring now to FIGS. 12 and 13, another package for containing, dispensing and displaying products 64 is shown at 130. The package 130 is similar to package 30 described above, in that the package 130 includes a rectangular floor 132, having a perimeter. An upstanding perimeter wall 140 extends from a bottom edge 143 upward to a top edge 142. The bottom edge 143 extends completely around the perimeter of the package floor 132. The perimeter wall 140 has a front wall 146 and a rear wall 144 extending transversely. A pair of opposed perimeter side walls 147 extends between the front 146 rear 144 walls. A detachable portion 170 of the package floor 132 is detachably removed therefrom, and is attachable to the top edge 142 of the perimeter wall 140 at the rear wall 144 to form a display header 152.

The detachable portion 170 forming the header 152 has a transverse dimension which is less than the dimension of the product contained in the package 130. A hole 172 is formed in the package floor 132 upon removing the detachable portion 170 from the package floor 132. The hole 172 has a hole transverse dimension 174. The hole transverse dimension 174 is less than a product transverse dimension when the product is contained in the package. This ensures that the product does not fall through the floor after removal of the display header 152.

The detachable portion 170 includes a tongue 156 formed by a non-straight slit 158 through the detachable portion 170. The detachable portion 170 is attachable to the rear wall 144. The tongue 156 is adapted to bend away from the detachable portion 170 sufficiently to allow the detachable portion 170 to sandwich the rear wall 144 between the header 152 and the tongue 156. This secures the header 152 to the package 130. The header 152 extends upward from the rear wall 144.

The package 130 differs from package 30 described above, in that the detachable portion 170 will sandwich the rear wall 144 with the tongue 156 behind the rear wall 144 and the header 152 in front of the rear wall 144, as shown in FIGS. 12 and 13. The top edge 142 of the rear wall 144 includes at least one upper part 176 and at least one lower part 178 disposed below the upper part 176. The detachable portion 170 attaches to the lower part 178 of the top edge 142 of the rear wall 144.

A lower axis of collapse 180A extends transversely across the rear wall 144 adjacent the rear wall lower part 178. An upper axis of collapse 180B extends transversely across the rear wall 144 adjacent the rear wall upper part 176. The axis of collapse 180A, 180B is a rotational centerline about which the header 152 would have to pivot if the header were to collapse either forward 166 or rearward 168, respectively. Thus, in order for the header 152 to collapse forward the header 152 will bend at the lower axis 180A. Similarly, in order for the header 152 to collapse rearward the header 152 will bend at the upper axis 180B. The upper part 176 is above the tongue 156, and behind the header 152, and will therefore resist any bending in the rearward direction 166. Thus, the upper part 176 will support the header 152 and preclude the header 152 from collapsing rearward. In addition, the rear wall 144 is contiguous with and at right angles to the side walls 147. The upper part 176 is thereby reinforced by the side walls 147.

Figure 14:
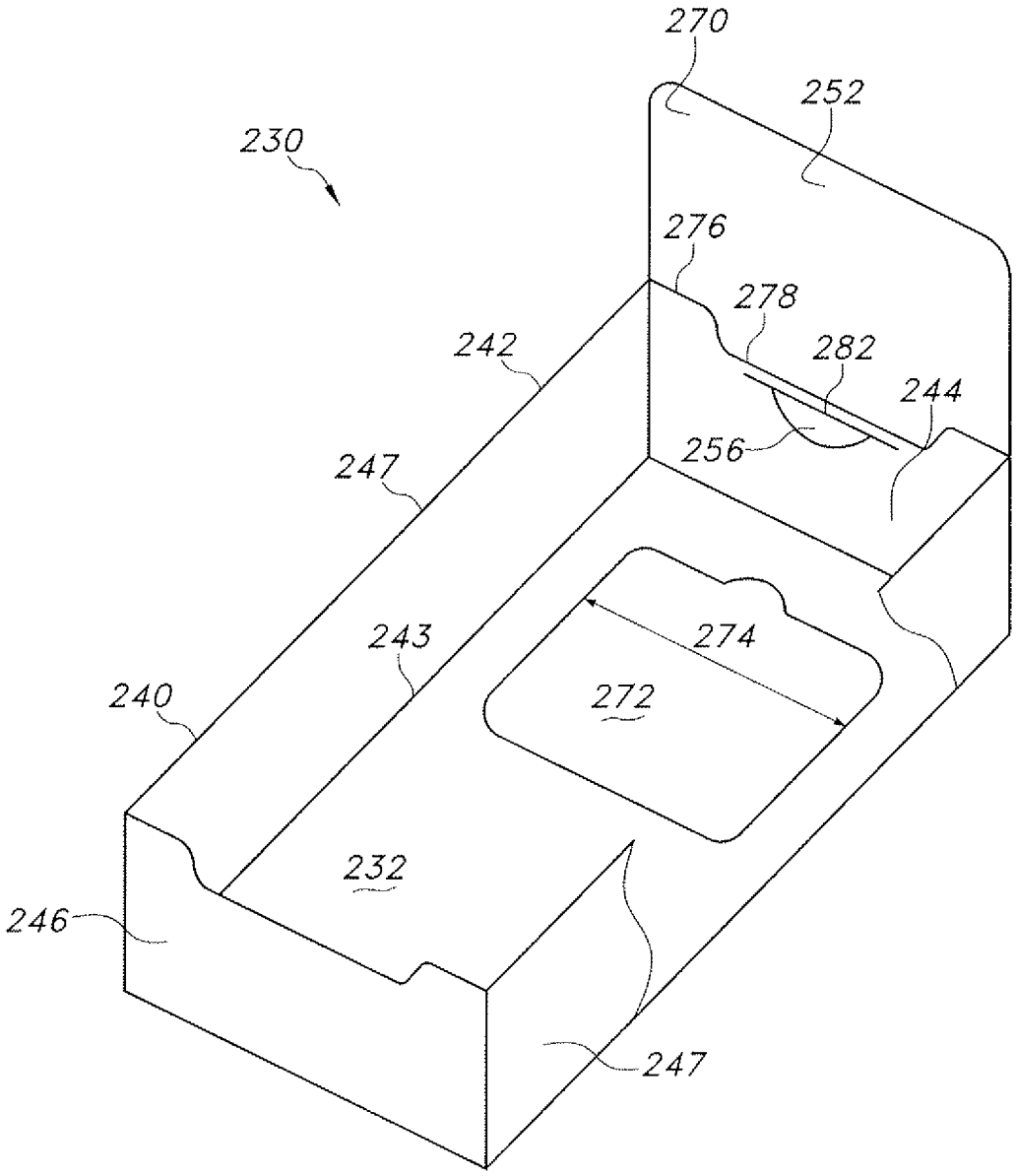
FIG. 14 is a top perspective view of yet another package constructed in accordance with the invention, and showing the display header attached to the package through a slit at the perimeter wall rear wall.

Turning now to FIG. 14, yet another package for containing, dispensing and displaying products 64 is shown at 230. The package 230 is similar to package 30 described above, in that the package 230 includes a rectangular floor 232, having a perimeter. An upstanding perimeter wall 240 extends from a bottom edge 243 upward to a top edge 242. The bottom edge 243 extends completely around the perimeter of the package floor 232. The perimeter wall 240 has a front wall 246 and a rear wall 244 extending transversely. A pair of opposed perimeter side walls 247 extends between the front 246 rear 244 walls. A detachable portion 270 of the package floor 232 is detachably removed therefrom, and is attachable to the perimeter wall 240 at the rear wall 244 to form a display header 252.

The detachable portion 270 forming the header 252 has a transverse dimension which is less than the dimension of the product contained in the package 230. A hole 272 is formed in the package floor 232 upon removing the detachable portion 270 from the package floor 232. The hole 272 has a hole transverse dimension 274. The hole transverse dimension 274 is less than a product transverse dimension when the product is contained in the package. Thus, the product does not fall through the floor after removal of the display header 252.

The detachable portion 270 includes a tongue 256 formed by a non-straight slit 258 through the detachable portion 270. The package 230 differs from package 30 described above, in that the rear wall 244 includes an assembly slit 282 therethrough and extending transversely across the rear wall 244. The detachable portion 270 is attachable to the rear wall 244 by inserting the tongue 256 through the rear wall assembly slit 282. The tongue 256 is adapted to bend away from the detachable portion 270 sufficiently to allow the detachable portion 270 to sandwich the rear wall 244 between the header 252 and the tongue 256. This secures the header 252 to the package 230. The header 252 extends upward from the rear wall 244.

The package 230 further differs from package 30 described above, in that the detachable portion 270 will sandwich the rear wall 244 with the tongue 256 projecting through the assembly slit 282 in the rear wall 244 with the header 252 behind the rear wall 244, and the tongue 256 in front of the rear wall 244, as shown in FIG. 14. The top edge 242 of the rear wall 244 may or may not include an upper part 276 and a lower part 278 as described above. The detachable portion 270 attaches to the rear wall 244, not at the top edge 242, but through the assembly slit 282.

As an alternative, the header can be disposed in front of the rear wall 244 (not shown). The tongue 256 projects through the assembly slit 282 in the rear wall 244 with the header 252 in front of the rear wall 244, and the tongue 256 behind the rear wall 244.

Turning now to FIGS. 15-19, as well as 1-8, another package for containing, dispensing and displaying products 64 is shown at 330. The package 330 is similar to package 30 described above, in that the package 330 includes a rectangular floor 332, having a perimeter. An upstanding perimeter wall 340 extends from a bottom edge 343 upward to a top edge 342. The bottom edge 343 extends completely around the perimeter of the package floor 332. The perimeter wall 340 has a front wall 346 and a rear wall 344 extending transversely. A pair of opposed perimeter side walls 347 extends between the front 346 rear 344 walls. A detachable portion 370 of the package floor 332 is detachably removed therefrom, and is attachable to the top edge 342 of the perimeter wall 340 at the rear wall 344 to form a display header 352.

The detachable portion 370 forming the header 352 has a transverse dimension which is less than the dimension of the product contained in the package 330. A hole (not shown) is formed in the package floor 332 upon removing the detachable portion 370 from the package floor 332. As described above, the hole has a hole transverse dimension that is less than a product transverse dimension when the product is contained transversely in the package. This ensures that the product does not fall through the floor after removal of the header 352.

Figure 15:
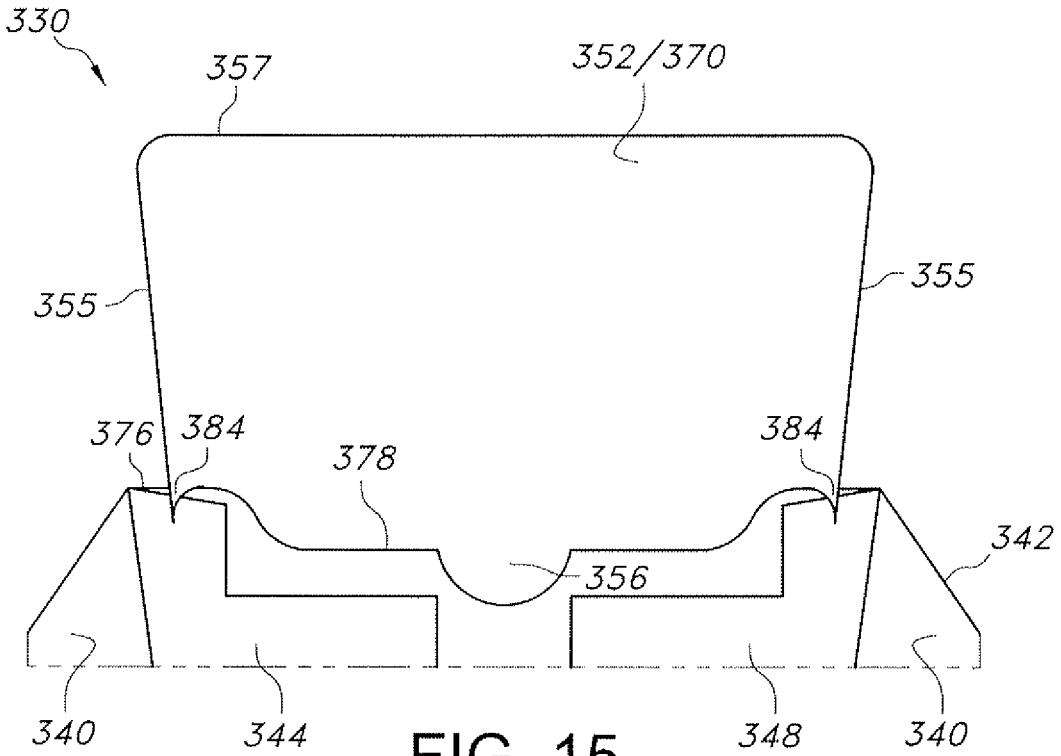
FIG. 15 is a top perspective view of still another package constructed in accordance with the invention, and showing the display header attached to the package with stabilizers and with the header behind the perimeter wall rear wall.
Figure 16:
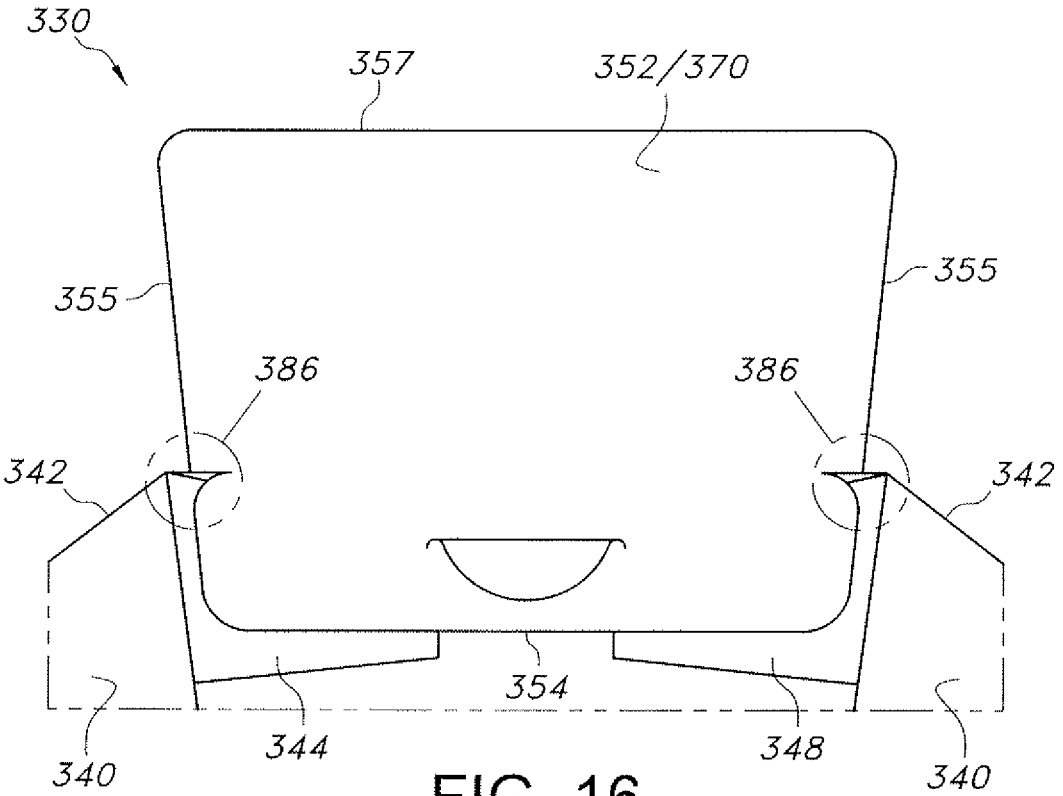
FIG. 16 is a top perspective view of the package of FIG. 15, and showing the display header attached to the package with stabilizers and with the header in front of the perimeter wall rear wall.
Figure 17:
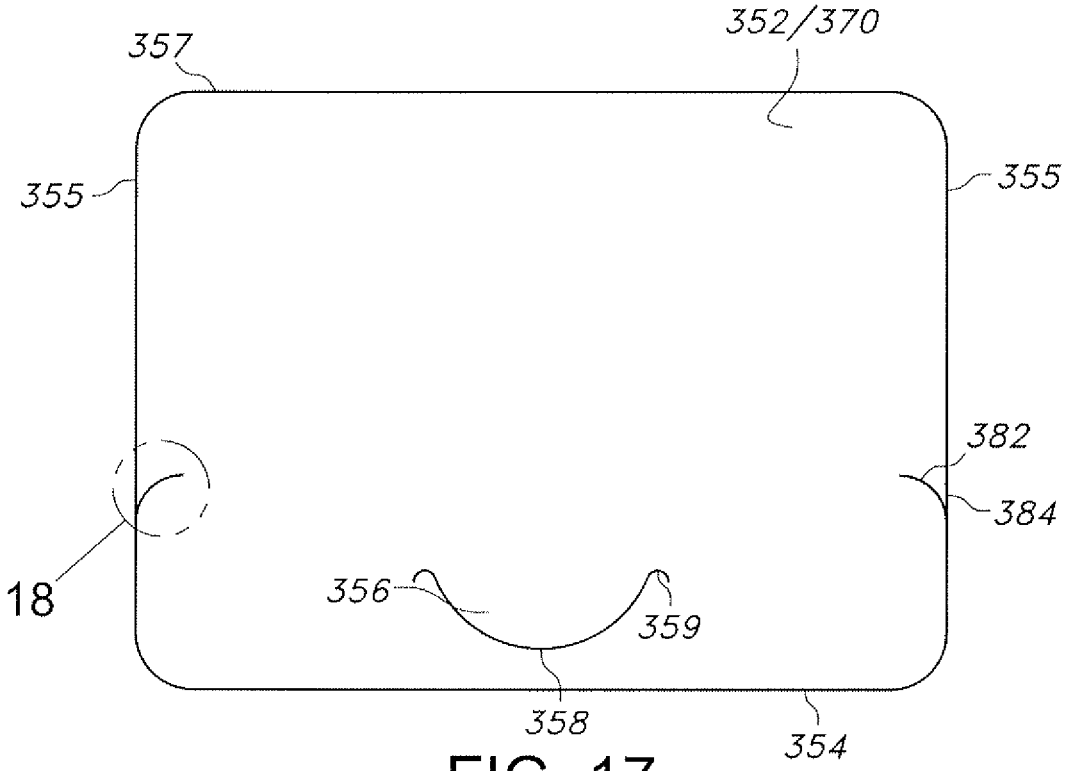
FIG. 17 is a front elevational view of the header of the package of FIG. 15, and showing the stabilizer slits and the stabilizers.

100531 The detachable portion 370 includes a tongue 356 formed by a non-straight slit 358 through the detachable portion 370. A tongue return slit 359 ensures that the non-straight slit 358 does not propagate across the header, tearing the header. The detachable portion 370 is attachable to the rear wall 344, as shown in FIGS. 15 and 16. The tongue 356 is adapted to bend away from the detachable portion 370 sufficiently to allow the detachable portion 370 to sandwich the rear wall 344 between the header 352 and the tongue 356. This secures the header 352 to the package 330. The header 352 extends upward from the rear wall 344.

The header 352 has a pair of opposed, upwardly extending side edges 355. The package 330 differs from package 30 described above, in that the detachable portion 370 includes a pair of stabilizers 384. Each stabilizer 384 of the pair of stabilizers 384 is formed by a stabilizer slit 382 through the detachable portion 370 along the header side edges 355. The stabilizers 384 are adapted to bend away from said detachable portion 370 sufficiently to allow the detachable portion 370 to sandwich the rear wall 344 between the header 352 and the stabilizers 384. The pair of stabilizers 384 extends downward along the header side edges 355, so that they can hook onto, or engage, the rear wall 344 on the top edge 376, which is also the perimeter wall top edge 342. When the pair of stabilizers 384 engages the rear wall 344, they stabilize the header 352 from tilting transversely to the left or right. The pair of stabilizers 384 also assists in preventing the header 352 from collapsing either forward or rearward.

The detachable portion 370 can be attached to the rear wall 344 with the header 352 behind the rear wall 344 and with the tongue 356 and the stabilizers 384 in front of the rear wall 344, as shown in FIG. 15. Alternatively, the detachable portion 370 can be attached to the rear wall 344 with the header 352 in front of the rear wall 344 and with the tongue 356 and the stabilizers 384 behind the rear wall 344, as shown in FIG. 16. The stabilizers 384 are in the stabilizer region 386 in FIG. 16.

Figure 18A:
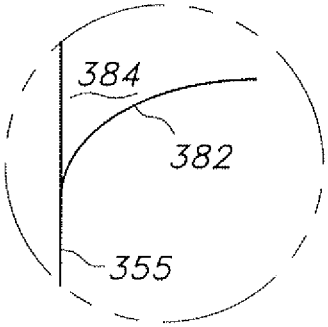
FIG. 18A is an enlarged, detail view of a stabilizer slit of the header of the package of FIG. 15, taken at detail 18 of FIG. 17.
Figure 18B:
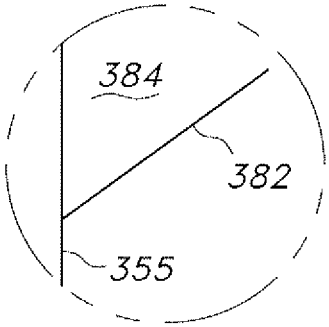
FIG. 18B is an enlarged, detail view of another stabilizer slit of the header of the package of FIG. 15, taken at detail 18 of FIG. 17.
Figure 18C:
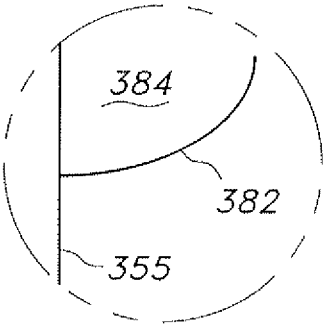
FIG. 18C is an enlarged, detail view of yet another stabilizer slit of the header of the package of FIG. 15, taken at detail 18 of FIG. 17.
Figure 18D:
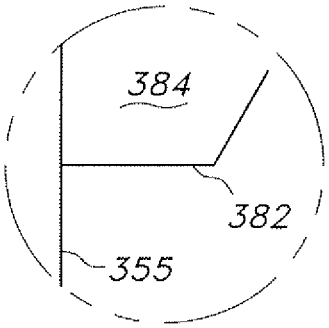
FIG. 18D is an enlarged, detail view of still another stabilizer slit of the header of the package of FIG. 15, taken at detail 18 of FIG. 17.
Figure 19:
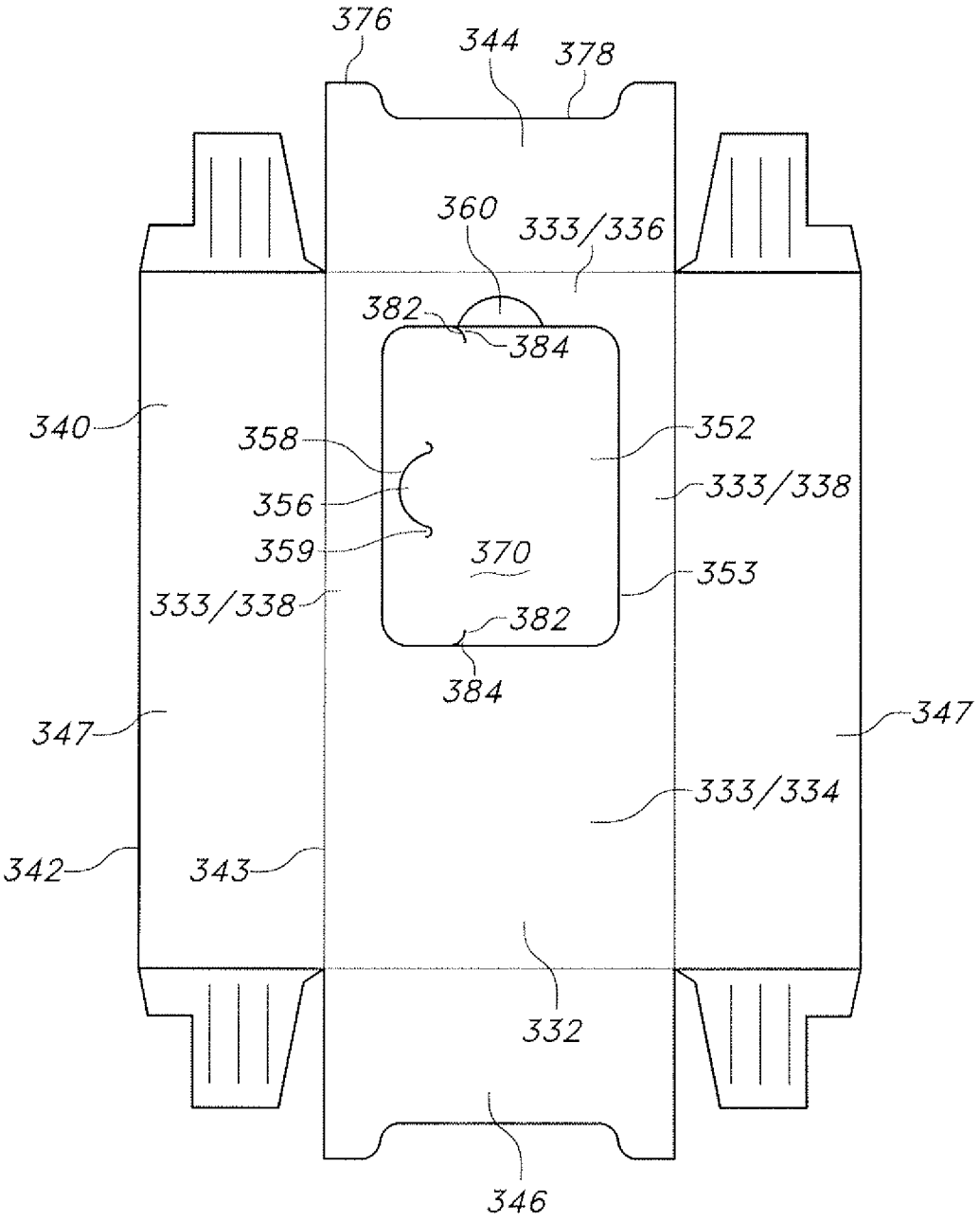
FIG. 19 is a top plan view of the package of FIG. 15, and showing a pattern layout of the package before cutting and folding to form the tray.

The stabilizer slits 382 through the detachable portion 370 may be any shape that forms a pair of downward-facing stabilizers 384. FIG. 18A shows a concave-downward shaped stabilizer slit 382, as is shown in FIGS. 15, 16, 17, and 19. FIG. 18B shows a downward sloping straight stabilizer slit 382. FIG. 18C shows a concave-upward shaped stabilizer slit 382. FIG. 18D shows two slits forming a trapezoid shaped stabilizer slit 382. These examples are non-limiting.

A method is disclosed for containing, dispensing and displaying products in a package. The method comprises providing the package with a package floor. An upstanding perimeter wall is extended around a perimeter of the package floor. A detachable portion is

What is claimed is:

1. A package for containing, dispensing and displaying confectionery product, the package comprising:

a package floor having a perimeter;

an upstanding perimeter wall having a bottom edge bounding the perimeter of said package floor and a top edge defining an open package top, said perimeter wall including a front wall, a rearwall and a pair of side walls; and a detachable portion of said package floor adapted for being detachably removed from said package floor and attachable to said rear wall to form a display header, said detachable portion further including a tongue formed by a non-straight slit through said detachable portion, said tongue being adapted to bend away from said detachable portion sufficiently to allow said detachable portion to sandwich said rear wall between said header and said tongue; wherein said detachable portion includes at least one of graphics and indicia, and wherein, upon attaching said detachable portion to said rear wall, said header extends upward from said rear wall.

2. The package of claim 1, wherein said detachable portion has a dimension less than the dimension of said confectionery product.

3. The package of claim 1 wherein:

the header further comprises a pair of opposed, upwardly extending side edges;

said detachable portion further comprises a pair of stabilizers, each one stabilizer of said pair of stabilizers being formed by a stabilizer slit through said detachable portion, the stabilizers being adapted to bend away from said detachable portion sufficiently to allow the detachable portion to sandwich the rear wall between the header and the stabilizers;

said pair of stabilizers extend downward along the header side edges; and said pair of stabilizers is adapted to engage the rear wall so as to stabilize the header.

4. The package of claim 1 wherein the detachable portion will sandwich the rear wall with the header behind the rear wall and the tongue in front of the rear wall.

5. The package of claim 4 wherein:

the top edge of said rear wall further comprises at least one upper part and at least one lower part disposed below the upper part;

said detachable portion attaches to the lower part of the top edge of said rear wall;

an upper axis of collapse extends transversely across the rear wall adjacent the rear wall upper part, such that in order for the header to collapse forward the header will bend at the upper axis;

a lower axis of collapse extends transversely across the rear wall adjacent the rear wall lower part, such that in order for the header to collapse rearward the header will bend at the lower axis; and the upper part will support the header so as to preclude the header from collapsing forward.

6. The package of claim 1 wherein the detachable portion will sandwich the rear wall with the tongue behind the rear wall and the header in front of the rear wall.

7. The package of claim 6 wherein:

the top edge of said rear wall further comprises at least one upper part and at least one lower part disposed below the upper part;

said detachable portion attaches to the lower part of the top edge of said rear wall;

an upper axis of collapse extends transversely across the rear wall adjacent the rear wall upper part, such that in order for the header to collapse rearward the header will bend at the upper axis;

a lower axis of collapse extends transversely across the rear wall adjacent the rear wall lower part, such that in order for the header to collapse forward the header will bend at the lower axis; and the upper part will support the header so as to preclude the header from collapsing rearward.

8. A package for containing, dispensing and displaying confectionery product, the package comprising:

a package floor being rectangular and having a perimeter;

an upstanding perimeter wall extending from a bottom edge upward to a top edge, the bottom edge extending completely around the perimeter of said package floor and the top edge defining an open package top, said perimeter wall having a front wall and a rear wall extending transversely across the package, and a pair of opposed side walls extending between the front wall and the rear wall; and a detachable portion of said package floor adapted for being detachably removed from said package floor and attachable to said rear wall to form a display header, said detachable portion further including a tongue formed by a non-straight slit through said detachable portion, said tongue being adapted to bend away from said detachable portion sufficiently to allow said detachable portion to sandwich said rear wall between said header and said tongue; wherein said detachable portion includes at least one of graphics and indicia, and wherein, upon attaching said detachable portion to said rear wall, said header extends upward from said rear wall.

9. The package of claim 8 wherein;

a hole is formed in said package floor upon removing said detachable portion from said package floor, the hole having a hole transverse dimension;

said hole transverse dimension is less than a product transverse dimension when said confectionery product is contained transversely in the package; and said confectionery product will not pass through said hole.

10. The package of claim 8 wherein:

the header further comprises a pair of opposed, upwardly extending side edges;

said detachable portion further comprises a pair of stabilizers, each one stabilizer of said pair of stabilizers being formed by a stabilizer slit through said detachable portion, the stabilizers being adapted to bend away from said detachable portion sufficiently to allow the detachable portion to sandwich the rear wall between the header and the stabilizers;

said pair of stabilizers extend downward along the header side edges; and said pair of stabilizers is adapted to engage the rear wall so as to stabilize the header.

11. The package of claim 8 wherein:

the detachable portion sandwiches the rear wall with the header behind the rear wall and the tongue in front of the rear wall;

the top edge of said rear wall further comprises at least one upper part and at least one lower part disposed below the upper part;

said detachable portion attaches to the lower part of the top edge of said rear wall;

an upper axis of collapse extends transversely across the rear wall adjacent the rear wall upper part, such that in order for the header to collapse forward the header will bend at the upper axis;

a lower axis of collapse extends transversely across the rear wall adjacent the rear wall lower part, such that in order for the header to collapse rearward the header will bend at the lower axis; and the upper part will support the header so as to preclude the header from collapsing forward.

12. The package of claim 8 wherein:

the detachable portion sandwiches the rear wall with the tongue behind the rear wall and the header in front of the rear wall;

the top edge of said rear wall further comprises at least one upper part and at least one lower part disposed below the upper part;

said detachable portion attaches to the lower part of the top edge of said rear wall;

an upper axis of collapse extends transversely across the rear wall adjacent the rear wall upper part, such that in order for the header to collapse rearward the header will bend at the upper axis;

a lower axis of collapse extends transversely across the rear wall adjacent the rear wall lower part, such that in order for the header to collapse forward the header will bend at the lower axis; and the upper part supports the header so as to preclude the header from collapsing rearward.

* * * * *